US008490256B2

(12) United States Patent
Carter et al.

(10) Patent No.: US 8,490,256 B2
(45) Date of Patent: Jul. 23, 2013

(54) RELEASE MECHANISM

(76) Inventors: Paul Carter, Fayetteville, NC (US); Andreas Hoertnagl, Fulpmes (AT)

( * ) Notice: Subject to any disclaimer, the term of this patent is extended or adjusted under 35 U.S.C. 154(b) by 183 days.

(21) Appl. No.: 12/952,044

(22) Filed: Nov. 22, 2010

(65) Prior Publication Data

US 2011/0126387 A1 Jun. 2, 2011

Related U.S. Application Data

(63) Continuation-in-part of application No. PCT/US2009/044950, filed on May 22, 2009, and a continuation-in-part of application No. PCT/US2009/045044, filed on May 22, 2009.

(60) Provisional application No. 61/055,267, filed on May 22, 2008, provisional application No. 61/153,545, filed on Feb. 18, 2009.

(51) Int. Cl.
*A44B 11/25* (2006.01)

(52) U.S. Cl.
USPC ..... 24/603; 24/634

(58) Field of Classification Search
USPC .... 24/602, 603, 606, 615, 616, 634; 119/772, 119/776; 2/102; 182/3
See application file for complete search history.

(56) References Cited

U.S. PATENT DOCUMENTS

| | | | | |
|---|---|---|---|---|
| 4,404,927 | A * | 9/1983 | Woutat | 119/776 |
| 6,487,761 | B2 | 12/2002 | Van Tassel | |
| 6,955,138 | B2 * | 10/2005 | DeBien | 119/776 |
| 7,162,978 | B2 * | 1/2007 | Debien | 119/772 |
| 7,640,639 | B2 * | 1/2010 | de Bien | 24/615 |
| 7,954,211 | B2 * | 6/2011 | De Bien | 24/606 |
| 8,181,318 | B2 * | 5/2012 | Anscher | 24/634 |
| 8,196,273 | B2 * | 6/2012 | Anscher | 24/606 |
| 8,209,825 | B2 * | 7/2012 | Carter | 24/634 |
| 2010/0313392 | A1 * | 12/2010 | Anscher | 24/616 |
| 2011/0127307 | A1 * | 6/2011 | Carter et al. | 224/271 |
| 2011/0239419 | A1 * | 10/2011 | Carter | 24/606 |

* cited by examiner

*Primary Examiner* — Robert J Sandy
*Assistant Examiner* — Louis Mercado
(74) *Attorney, Agent, or Firm* — Michael J. Dimino; Johnson, Marcou & Isaacs, LLC

(57) ABSTRACT

Arrangement with one or more buckles, wherein each buckle has at least two buckle parts that are detachably connectable with each other, at least one release mechanism, actuatable by means of pressure for detaching the buckle parts from each other, and at least one pressure accumulator connected via at least one pressure line with the buckle(s) for actuating the release mechanism of the buckle, and with at least one release valve for opening a pressure connection guided via the pressure line between the pressure accumulator and the buckle or the buckles, and with at least one trigger for actuating the release valve, wherein the arrangement has a pump for the build-up of pressure in the pressure accumulator.

15 Claims, 12 Drawing Sheets

RELEASE MECHANISM

CROSS REFERENCE TO RELATED APPLICATIONS

This application is a continuation-in-part of pending International Pat. App. No. PCT/US09/44,950 filed May 22, 2009, which claims the benefit of U.S. Provisional Pat. App. No. 61/055,267 filed May 22, 2008. This application is a continuation-in-part of pending International Pat. App. No. PCT/US09/45,044 filed May 22, 2009, which claims the benefit of U.S. Provisional Pat. App. No. 61/055,267 filed May 22, 2008 and U.S. Provisional Pat. App. No. 61/153,545 filed Feb. 18, 2009.

FIELD

The technology disclosed herein (the "technology") relates to attachment arrangements that can be remotely separated by a transfer of stored energy.

BRIEF DESCRIPTION OF THE DRAWINGS

Reference will now be made, by way of example, to the accompanying drawings which show example implementations of the present application.

Further details and features of preferred implementations according to the technology will be apparent from the description of the figures, in which are shown.

DETAILED DESCRIPTION

Figure 1:
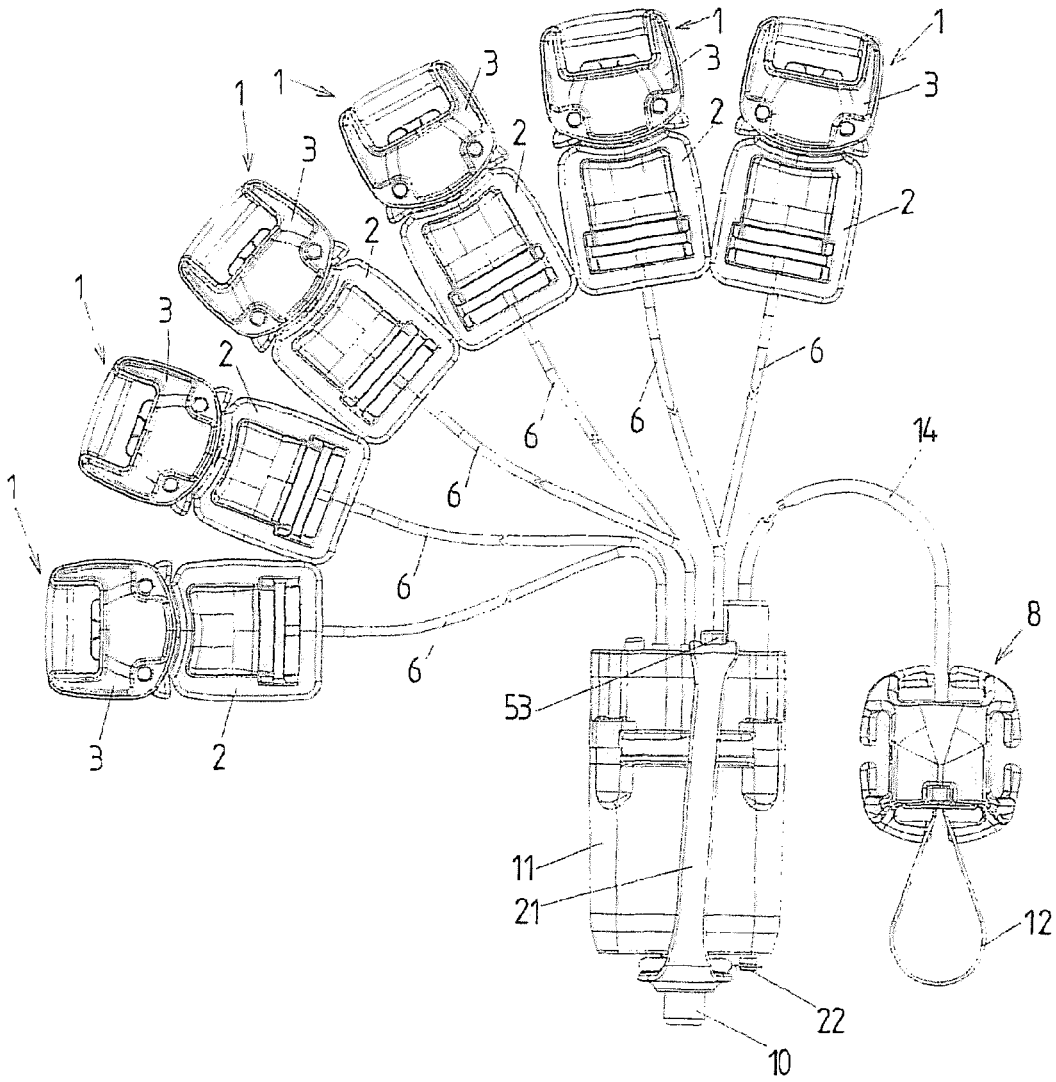
FIG. 1 a first example implementation according to the technology of an arrangement for the remote release of the buckles.

Reference will now be made in detail to implementations of the technology. Each example is provided by way of explanation of the technology only, not as a limitation of the technology. It will be apparent to those skilled in the art that various modifications and variations can be made in the present technology without departing from the scope or spirit of the technology. For instance, features described as part of one implementation can be used on another implementation to yield a still further implementation. Thus, it is intended that the present technology cover such modifications and variations that come within the scope of the technology. Arrangements according to the technology can be used for example in the military field, but also in all other fields in which people must carry loads, such as for example in mountaineering.

The present technology relates to arrangements comprising:

- one or more buckles, wherein each buckle can have at least two buckle parts that can be detachably connectable with each other, and at least one release mechanism, able to be actuated by means of pressure, for detaching the buckle parts from each other,
- at least one pressure accumulator that can be connected via at least one pressure line with a buckle for actuating the release mechanism of the buckle,
- at least one release valve for opening a pressure connection, guided via the pressure line, between the pressure accumulator and the buckle, and
- at least one trigger for actuating the release valve.

The technology can be used for example when the concern is with a person having to carry loads on his body that he must be able to separate himself from quickly in an emergency situation or suchlike. The technology can for example be integrated into a belt system of a backpack or suchlike. By opening the buckle or buckles in an emergency situation or suchlike, the person can readily free himself, by means of the arrangement, from the backpack or from another load fastened to him. An advantage exists in the technology in that the buckle can be opened from a remote location by remote release. This can be beneficial for example when the buckle is arranged at a location that is inaccessible or is only accessible with difficulty. An advantage of the technology in the case of several buckles additionally can be found in that the person does not have to open each buckle individually, but rather a plurality of buckles can be opened concurrently by a single actuation of the trigger.

WO 2009/143 410 A2 discloses a system that is similar in its basic features, the disclosure of which is hereby incorporated by reference in its entirety. However, in that reference, operations can be carried out by cable pulls in order to open the buckles centrally or by means of remote release. The cable pulls that can be used there have the problem that they may be relatively rigid and therefore may be difficult to integrated into a corresponding belt system of a backpack or suchlike. Furthermore, the function may be impaired or lost by the penetration of dirt into these cable pulls. In order to improve this, WO 2009/143 464 A2 discloses arrangements in which the buckles or their buckle parts can be detached from each other by means of pneumatic or hydraulic pressure transfer.

The example implementations of FIG. 12 to 20 of WO 2009/143 464 A2 show variants in which the pressure lines leading to the buckles may be connected directly to a piston/cylinder arrangement, in which for the build-up of pressure for opening the buckles, the piston may be pulled accordingly strong by hand via a trigger. Such variants have the disadvantage in that the required pressure must be applied by pulling on the trigger, e.g., by the person who wishes to free himself of his load. If the person is injured or if the trigger is difficult to access, then this is potentially not possible, because the person may not be able to apply the pressure required for opening the buckles.

The arrangement disclosed in FIG. 34 to 38 of WO 2009/143 464 A2 may circumvent this problem by having a pressure accumulator. In these variants, the pressure required for opening the buckles may be stored in the pressure accumulator. The charging of the pressure accumulator may take place via a pressure cartridge. If the cartridge is empty or if only too little pressure is available in it, then such arrangements also may no longer be ready for use. Particularly when such arrangements are used in areas that may be difficult to access or military combat operations, this may lead to the total failure of the system, which is not acceptable in an emergency.

Implementations of the present technology include a pump for the build-up of pressure in the pressure accumulator, in part to address problems such as those identified above.

The pump provided according to the technology can allow pressure sufficient for concurrent remote release of one or more buckles to be built up in the pressure accumulator. This is possible without the procurement of consumable items such as, for example, pressurized cartridges or suchlike. Hereby, the reliability and operating safety of the arrangement can be increased.

Implementations of the technology make provision that the pump is able to be actuated manually by means of a grip element of the pump.

In implementations of the disclosed technology, remote release for detaching the buckle parts of one or more buckles is possible by use of the pressure stored in the pressure accumulator, by the trigger being actuated. Furthermore, if several buckles are present, these can be opened concurrently by a single actuation of the trigger, i.e., by a single, central action.

A pressure accumulator in the sense of the technology is understood to mean a cavity surrounded by a wall, in which pressure can be stored until the pressure is directed, by opening the release value, via the pressure lines to the release mechanisms of the buckles, in order to release them. Pressure in the pressure accumulator, sufficient to release the buckles connected thereto, can be built up by use of the pump according to the technology. Implementations of the technology include a gaseous medium as a transmission medium in the pressure accumulator and in the pressure lines. Implementations of the technology can be therefore advantageously pneumatic systems. Hydraulic systems also can be used, in which a hydraulic fluid, such as for example oil or suchlike, is situated in the pressure accumulator and in the pressure lines. Some implementations can include membrane pressure accumulator, in which a first partial volume is filled with the hydraulic fluid and a second partial volume is filled with a gas, wherein by corresponding build-up of pressure the gas in the last-mentioned partial volume is compressed and transfers the pressure to the hydraulic fluid via the membrane.

The pressure lines can be advantageously flexible pressure tubes. The pressure lines can be generally lines through which pressure can be transferred pneumatically and/or hydraulically. In some implementations of the technology, each release mechanism of a buckle can be connected with the pressure accumulator by a separate pressure line. Some implementations of the technology can connect several release mechanisms of several buckles with each other in series by a single pressure line.

In implementations having several buckles, one can also speak in terms of a "central" pressure accumulator as an element of the technology. The term "central" in this context does not, however, necessarily mean that the pressure accumulator is to be arranged locally in the center. Rather, this means that a shared pressure accumulator can provide the pressure for the actuation of several release mechanisms of several buckles. The pressure accumulator advantageously can have a minimum volume of 5 $cm^3$, preferably 15 $cm^3$. Advantageously, at least 5 $cm^3$ volumetric proportion can be provided per buckle in the pressure accumulator.

A compact type of construction can be produced if at least the pressure accumulator and the pump are arranged in a shared housing. In implementations in which the pressure accumulator is to be arranged in a location that may be rather more difficult to access, the pressure accumulator and the pump can have separate housings that can be connected with each other via a pressure line. The pressure accumulator then can be positioned at a location that is rather more inaccessible, whereas the pump can be arranged at a readily accessible location.

The pressure accumulator and the buckle or the buckles can be separate components of the arrangement that are connected with each other by means of at least one pressure line or with a pressure line each. The term "separate component" means here in particular that the buckle and the pressure accumulator do not have a shared housing.

In some embodiments, the trigger can be controlled electronically, e.g., by direct connection, via radio. Generally, however, it is advantageous if the trigger has a release element that is able to be actuated by hand. This type of trigger is particularly simple to operate and reliable.

In this context, in a first group of implementations according to the technology at least the pressure accumulator and the pump can be arranged in a shared housing, and the manually actuatable release element is arranged directly on the shared housing. In other implementations the manually actuatable release element for actuating the release valve can be connected with the release valve via an electric cable, via a Bowden cable, or via combinations thereof. In the last mentioned cases, the pressure accumulator and the release element of the trigger can in turn be arranged at positions that are distant from each other.

Some implementations of the technology make provision that the pump has at least one pump plunger and at least one pump cylinder, wherein the pump plunger for pumping in the pump cylinder can be displaceable to and fro between a maximum extended position and a maximum retracted position. In some implementations a grip element of the pump is arranged on the pump plunger, that is able to be gripped by hand in the maximum retracted position. In some implementations having a grip element, at the end region of the pump plunger on the grip element side a seal is arranged that can seal the pump cylinder with respect to the exterior in the maximum retracted position. This can reduce the likelihood of dirt penetrating the pump. So that the pump plunger remains in its maximum retracted position when pumping does not have to be carried out, some implementations can include an arresting device for the pump plunger, by which the pump plunger is able to be arrested in the maximum retracted position. The arresting device can, for example, be a tension band. In some implementations the plunger can be fixed in its position and the cylinder can be movable. For these variants, with respect to the abovementioned variants, in so far as applicable, the same applies. The grip element is then arranged for example on the pump cylinder and the arresting device then provides for the pump cylinder to be arrestable in the maximum retracted position.

FIG. 1 shows a plurality of buckles 1 that are respectively connected via pressure lines 6 in the form of flexible tubes with a shared housing 11 in which both the pressure accumulator 5 and also the pump 9 for charging the pressure accumulator can be arranged. Only the grip element 10 of the pump 9 can be seen in FIG. 1, that can serve for the manual actuation of the pump.

So that the pump plunger 17, on which the grip element 10 of this example implementation is mounted, cannot be extended inadvertently when the pump 9 is not to be actuated at all, an arresting device 21 can be provided, here in the form of a tension band, by which the pump plunger 17 can be arrested in the maximum retracted position. If the pump 9 is to be actuated, then the band that is used here as arresting device 21, can be released from the fastening pin 53, so that then by corresponding movement to and fro of the pump plunger 17 the pump 9 can be actuated and the pressure accumulator 5 can be charged.

In this example implementation, the release valve 7 is arranged in the shared housing 11. By opening this release valve 7, a pressure connection can be produced via the pressure lines 6 between the pressure accumulator 5 and the release mechanisms 4, shown further below in detail by way of example, so that by corresponding pressure actuation of the respective release mechanisms 4 the two buckle parts 2 and 3 of each buckle 1 can be detached from each other. The pressure stored in the pressure accumulator 5 can be set by means of the pump 9 to be so high that it is sufficient, on actuation of the trigger 8 or of its release element 12, to actuate the release mechanisms 4 of each attached buckle(s) 1 concurrently, in order to thus open the buckle(s) 1 by remote release.

In the example implementation that is shown according to FIG. 1, the trigger 8 is connected with the release valve 7 via the Bowden cable 14. If the release element 12 is pulled in one of the drawing directions 15, then the release valve 7 can be opened under compression of its spring 32. If one lets go of the release element 12 again, then the spring 32 presses the release valve 7 again against its valve seat, so that it can be closed again.

In some implementations of the technology, the release element 12 can be actuated by pulling in drawing directions 15 that are different from each other, wherein, viewed in at least one plane, drawing directions are possible in an angle range of at least 90°, preferably of at least 180°. The position of rest is illustrated in the sections according to FIGS. 2 and 3. FIG. 4 shows the release element 12 in a deflected position, in which the release valve 7 can be opened via corresponding traction on the Bowden cable 14.

Figure 2:
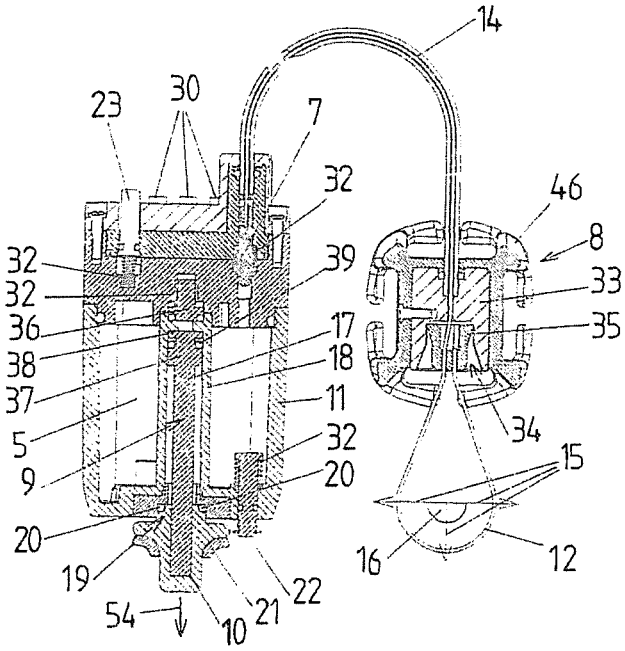
FIG. 2 a first longitudinal section through the shared housing and the trigger of the first example implementation according to FIG. 1.
Figure 3:
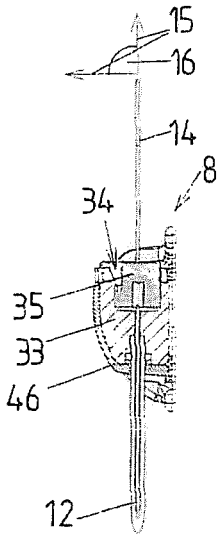
FIG. 3 a longitudinal section, rotated through 90°, through the trigger of FIG. 1.
Figure 4:
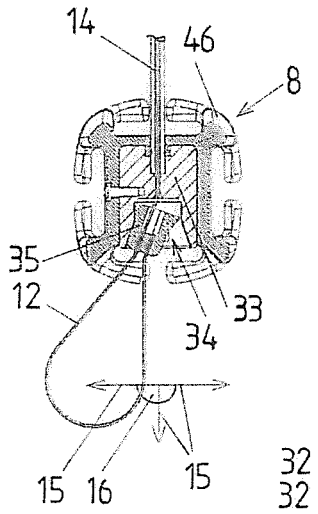
FIG. 4 a section through the trigger according to FIG. 1, in which the release element is actuated.
Figure 5:
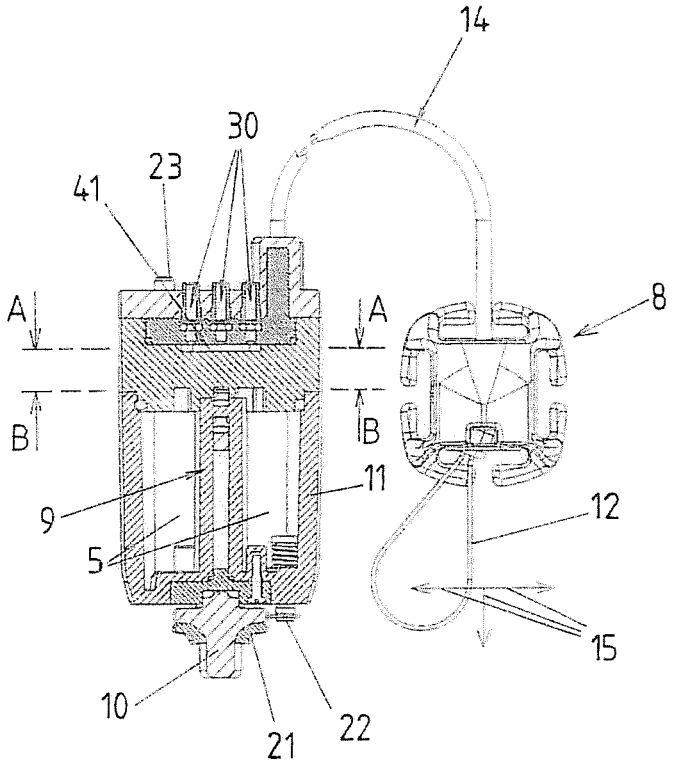
FIG. 5 a second longitudinal section through the shared housing and the trigger of FIG. 1 in a second section plane.

In the example implementation that is shown, the angle range 16 of the possible drawing directions 15, viewed in the section plane according to FIGS. 2 and 4, is at least 180° and in the section plane according to FIG. 3, orthogonal thereto, at least 90°. In order to achieve this, in the example implementation that is shown, the trigger 8 can have a bearing sleeve 33 arranged in the trigger housing 46, the sleeve can have a recess 34 in which a support element 35, fastened on the release element 12, can be arranged. The recess can be widened accordingly in a funnel shape, whereby the different drawing directions 15 become possible. Advantageously, the support element 35, fastened on the release element 12, can be tilted with respect to the bearing sleeve 33 and/or with respect to the trigger housing 46, forming the effect of a lever arm. Hereby, the forces that are required for actuating the release element 12 can be reduced. This transmission or respectively formation of the lever arm can be seen particularly well, when comparing the positions of the support element 35 according to FIG. 2 and according to FIG. 4.

In the longitudinal section according to FIG. 2, a pressure accumulator 5 and parts of a pump 9 can be seen. The pump plunger 17 can be mounted displaceably in the pump cylinder 18. In its end region 19 on the grip element side, the grip element 10 can be mounted on the pump plunger 17, with which the pump plunger 17 and hence the pump 9 can be actuated by hand. In FIG. 2 the pump plunger 17 is shown in the maximum retracted position. In its end region 19 on the grip element side, the pump plunger can have a seal 20 by which it can seal the pump cylinder 18 in this maximum retracted position. This can reduce the likelihood that dirt or liquid may penetrate into the pump cylinder 18, when pumping is not being carried out. For the pumping process for charging the pressure accumulator 5, firstly the arresting device 21 can be detached, in the example implementation shown, from the fastening pin 53. Hereby, the pump plunger 17 can be freed.

Figure 7:
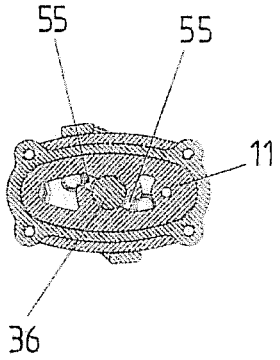
FIG. 7 the cross-section along the section plane BB of FIG. 5.

It can then be drawn out from the pump cylinder 18 in the direction 54, until it reaches its maximum extended position, which is not illustrated here. With this drawing out of the pump plunger 17, air or gas can flow through an annular gap around the piston 37 of the pump plunger 17 and past the T-shaped head 38 and the seal 39 arranged therebetween, into the interior of the pump cylinder 18. If the pump plunger 17 is then subsequently pressed into the pump cylinder 18 again in the opposite direction to direction 54, i.e., in the direction towards its fully retracted position, then the build-up of pressure that is thereby reached can close the annular gap around the piston 37 by use of the seal 39 and open in the pump cylinder 18 the overflow valve 36 by compression of its spring 32. The air, which is under pressure, from the pump cylinder 18 then can flow into the pressure accumulator 5 via the overflow ducts 55 illustrated in section according to FIG. 7. By a repetition of this pumping process, pressure sufficient to release the buckles connected thereto can be built up in the pressure accumulator 5 with the release valve 7 closed, and stored until it is required, in order to actuate the release mechanisms 4 of the buckles 1. In order to be able to monitor the pressure prevailing in the pressure accumulator 5, a pressure indicator 22 can be provided in the wall of the housing 11 surrounding the pressure accumulator 5. By the pressure that is present in the pressure accumulator 5, the pressure indicator 22 can be pressed a distance out from the housing 11 against the elastic force of the spring 32 that is associated with it. The pressure in the pressure accumulator 5 can then be read, for example, by a corresponding marking on the outer surface of the pressure indicator 22. The variant of a pressure indicator that is illustrated here is only one of many possibilities. Other pressure indicators known in the prior art can also be used accordingly.

Furthermore, it is advantageous if the pressure accumulator 5 or the wall surrounding it has a pressure relief valve that can release excess pressure in the pressure accumulator 5 when a pre-settable pressure level is reached. In the example implementation that is shown, a pressure relief valve is integrated into the pressure indicator 22.

Figure 6:
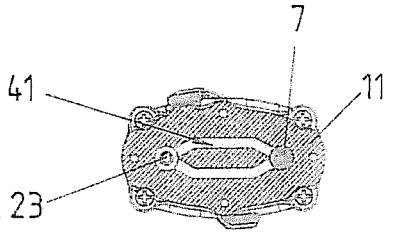
FIG. 6 the cross-section along the section plane AA of FIG. 5.

When the pump plunger 17 is in the maximum retracted position shown in FIG. 2, the overflow valve 36 is closed. The pressure in the pressure accumulator 5 is confined between the overflow valve 36 and the release valve 7. The arrangement that is shown can remain in this state until release of the buckles 1 is desired. This can be the case for example when a person must separate himself from a load, or must be separated therefrom, by opening the buckles 1 in an emergency situation. For this, it suffices to pull on the release element 12 in one of the drawing directions 15. The release valve 7 is then opened, as already described, and the pressure transmission medium that is stored under pressure in the pressure accumulator 5 then can flow past the release valve 7 through the overflow ducts 41, which are to be seen in section according to FIG. 6, and the pressure lines 6 to the respective release mechanism 4 of a buckle 1, in order to actuate it and hence to detach the buckle parts 2 and 3 from each other. Release mechanisms that are able to be used according to the technology are known in the prior art and are also shown for example in WO 2009/143 464 A2. Nevertheless, an example of a buckle 1 with a suitable release mechanism is illustrated once again in FIGS. 12 to 16 and is described further below.

In the example implementation that is shown, a ventilation valve 23 is provided, that can allow the pressure that is built up for releasing the release mechanisms 4 in the pressure lines 6 to be reduced again, so that the buckle parts 2 and 3 of the respective buckle 1 can be fastened to each other again. For this, the ventilation valve 23, as can be seen in particular in FIG. 6, can be connected with the overflow ducts 41 and via these also with the pressure lines 6, so that by opening the ventilation valve 23 the pressure transfer medium, which is under pressure, can flow out from the pressure lines 6 and hence also out from the release mechanisms 4 of the individual buckles 1 towards the exterior.

Figure 8:
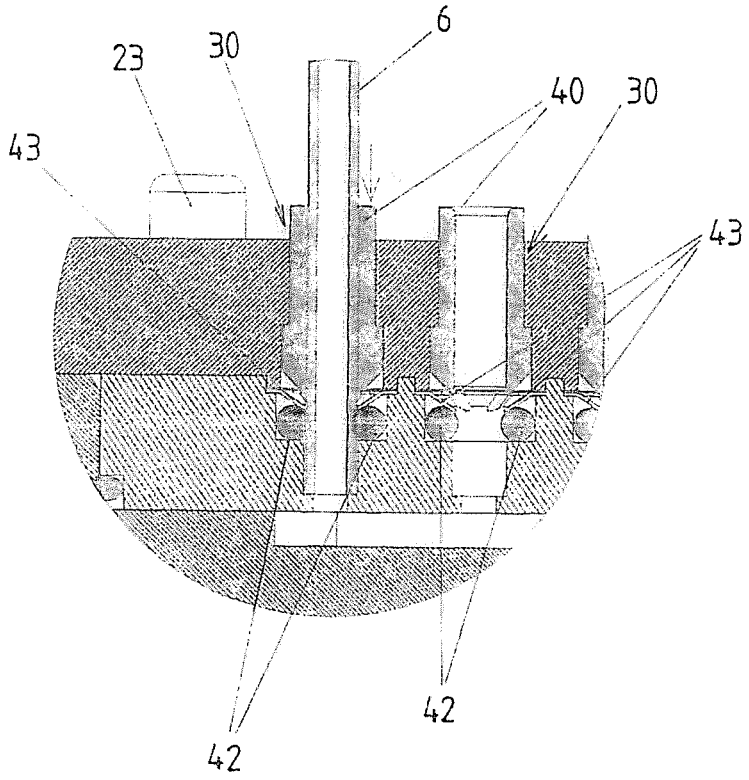
FIG. 8 a detail illustration for the fastening of the pressure lines on the shared housing.

FIG. 8 shows in detail a form of the fastening of the pressure lines 6 on the shared housing 11. The fastening arrangement 30 can have displaceably mounted connecting sleeves 40, into which respectively a pressure line 6 can be inserted in the arrow direction should in FIG. 8. When the pressure line 6 is inserted accordingly far into the connecting sleeve 40, it can strike onto the spring plate 43. With deformation of this spring plate 43 or respectively its spring tongues, the pressure line 6 then can be pushed past the respective seal 42, until it reaches the end position illustrated in FIG. 8. In this position, it can be arrested by the spring tongues of the spring plate 43 pinching into the outer wall of the pressure line 6.

This is an example of a fastening arrangement 30 that can allow the pressure line 6 to be fastened in a pressure-resistant manner by pushing in on the shared housing 11. The seal 42 can seal off the connecting region with respect to the exterior in a pressure-resistant manner in the pushed-in state of the pressure line 6. In the example implementation that is shown according to FIG. 8, the pressure lines 6 also can be detached out from their fastening arrangements 30. For this, the respective connecting sleeve 40 can be pressed in the arrow direction, whereby the spring tongues of the spring plate 43 can be detached again from the pressure line 6 and the pressure line 6 can be drawn out from the respective connecting sleeve 40. Other fastening arrangements that are known in the prior art can also be used at this point.

Figure 9:
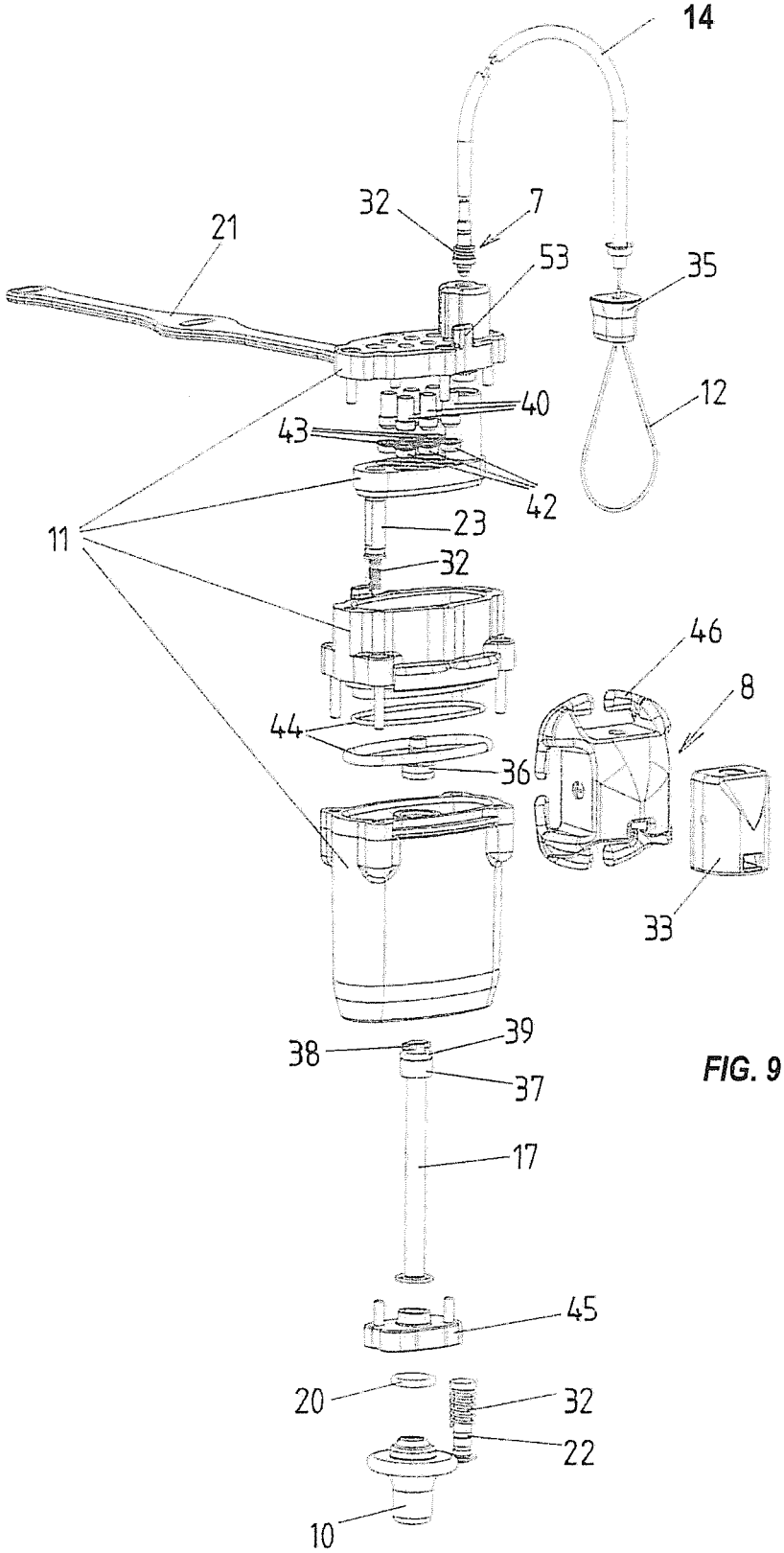
FIG. 9 an exploded illustration for the shared housing and trigger of the example implementation according to FIG. 1.
Figure 10:
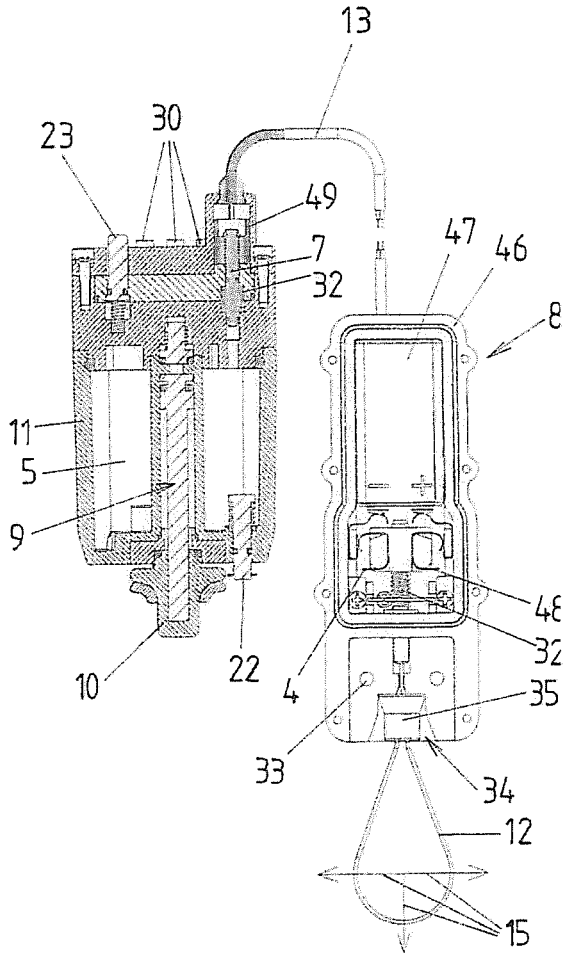
FIG. 10 the shared housing and the trigger of a second variant implementation of the technology in a longitudinal section.

FIG. 9 shows an exploded illustration of parts in the region of the shared housing 11 and of the trigger 8. The sealing rings 44 between the individual parts of the shared housing 11, and the closure cover 45, that can close the pump cylinder 18 with respect to the exterior and encompasses the pump plunger 17, can be seen. FIG. 10 shows a longitudinal section, analogous to FIG. 2, through a second example implementation technology. The pressure lines 6 and buckles 1 are not illustrated again here. Their implementation and their fastening on the shared housing 11 can be realized as in the first example implementation. In the second example implementation according to FIG. 10, one difference from the first example implementation is that the connection between the trigger 8 and the shared housing or respectively release valve 7 is not produced via a Bowden cable 14, but rather can be via an electric cable 13. A battery 47 can be situated in the trigger housing 46.

By pulling on the release element 12, the contacts 48 in the trigger housing 46 can be closed such that the electric cable 13 can be energized by the battery 47. Hereby, an electric magnet 49 can be activated, that through the build-up of a corresponding magnetic field can open the release valve 7 under compression of the spring 32 that is associated with it. When one lets go of the release element 12 again, the contacts 48 can be separated again. The magnetic field in the magnet 49 can be decreased and the release valve 7 can be closed by the spring 32 again. This is therefore an example that the release valve 7 can not only be actuated mechanically, but also electrically.

Figure 11:
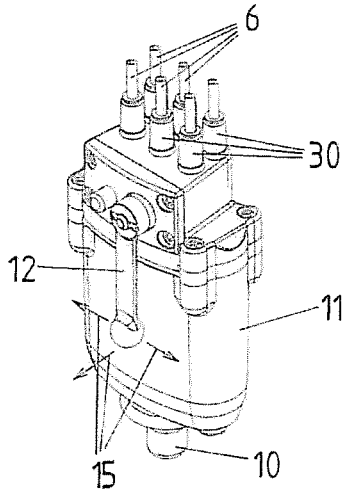
FIG. 11 a third variant implementation according to the technology of a shared housing with integrated trigger.

Whereas in the first two example implementations that were described, the trigger 8 and the pressure accumulator 5 or respectively the shared housing 11 can be arranged at a distance from each other, FIG. 11 shows a third example implementation according to the technology, in which the release element 12 of the trigger 8 can be mounted directly on the shared housing 11. The release element 12 of this example implementation can be constructed such that, irrespective of which of the target directions 15 it is pulled on, an opening of the release valve 7 and hence, via the corresponding release mechanisms 4 in the buckles 1, a separation of the buckle parts 2 and 3 can be brought about. Advantageously, the release element 12 according to FIG. 11 can be made of an elastic material.

Figure 12:
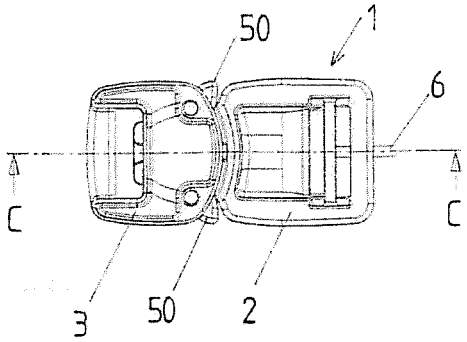
FIG. 12 a buckle with pressure line.

By means of FIGS. 12 to 16, a buckle 1 that can be used for an arrangement according to the technology, and the release mechanism 4 associated with it, are now additionally described by way of example. FIG. 12 shows an external view of the buckle 1, in which the two buckle parts 2 and 3 can be connected with each other and can be engaged with each other via the lock 27.

Figure 13:
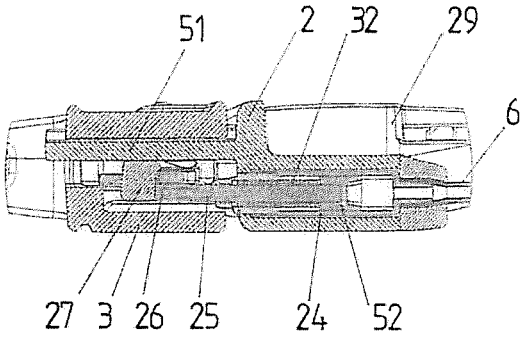
FIG. 13 the longitudinal section along the section plane CC through the buckle according to FIG. 12.
Figure 14:
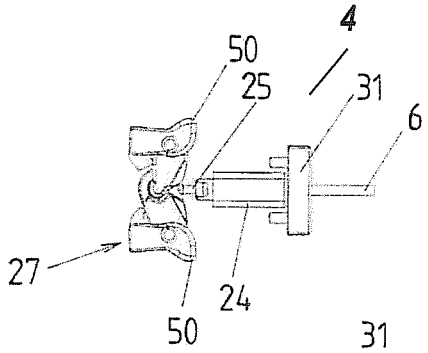
FIG. 14 the release mechanism of the buckle according to FIG. 12.

Advantageously, as also here in the example implementation that is shown, each buckle 1 can be actuated individually via manually actuatable buttons 50, i.e., that by actuating the buttons 50, the two buckle parts 2 and 3 can be separated from each other, without the central releasing via the pressure accumulator 5 and the trigger 8 being required for this. This actuation of the respective locking mechanism 27 via the buttons 50 comes into consideration particularly in normal operation, in which sufficient time is available to open the buckles 1 individually. In the top view according to FIG. 12; a portion of the pressure line 6 can also be seen in addition to the buckle 1. FIG. 13 shows a longitudinal section along the section line CC of FIG. 12. Here, it can firstly be seen how in the inserted state the male extension 51 of the buckle part 2 can be arranged and locked in a corresponding female recess in the buckle part 3. Suitable locks 27 are known in the prior art and do not have to be further described again here. In particular in this respect, reference can also be made to WO 2009/143 464 A2. For remote release by means of the trigger 8 and pressure accumulator 5, in each buckle 1, here in the male buckle part 2, a release cylinder 24 can be connected with the pressure line 6. In this cylinder, a release plunger 25 can be displaceably mounted. In the example implementation that is shown, the latter can carry at its end pointing towards the pressure line 6 the release plunger piston 52. When the release valve 7 is opened and the pressure line 6 is placed under pressure, the release plunger piston 52 and hence the entire release plunger 25 can be moved out in the direction towards the lock 27. The release plunger 25 then can open the lock 27 with its actuating end 26, whereby the two buckle parts 2 and 3 are separated from each other. The stroke of the release plunger 25 can not only open the lock 27, but also can push apart the two buckle parts 2 and 3 so far apart that re-locking of the lock 27 is prevented. If, by opening of the ventilation valve 23, the pressure in the pressure line 6 and hence also in the release cylinder 24 is decreased, then the restoring spring 32 can return the release plunger 25 again into the maximum retracted position shown in FIG. 15. So that dirt is less likely to penetrate into the release cylinder 24 in this position, each release mechanism of a buckle 1 can have a release plunger 25, mounted so as to be displaceable in a release cylinder 24 between a maximum retracted position and a maximum extended position; wherein the release plunger 25 can have an actuating end 26 by which it can actuate a lock 27 of the buckle parts 2, 3 for detaching the buckle parts 2, 3 from each other; wherein the release plunger 25 in the region of the actuating end 26 can have a seal 28, that can seal off the release cylinder 24 with respect to the exterior in the maximum retracted position of the release plunger 25.

Figure 15:
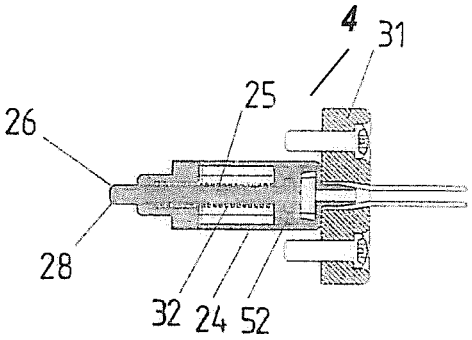
FIGS. 15 and 16 parts of this release mechanism.
Figure 16:
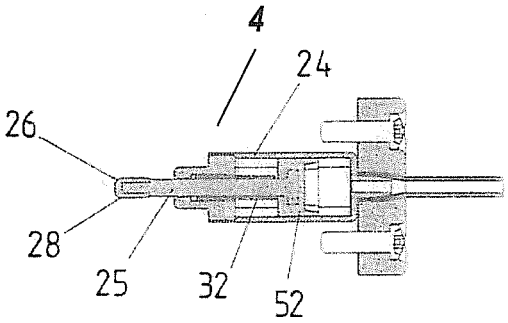

In the position according to FIG. 15, this seal 28 on the actuating end 26 can seal off the release plunger 24 toward the exterior. In some implementations of the technology, the pressure lines 6 can form pre-fabricated units with the release plunger cylinders 24 and the release plungers 25 and with fastening arrangements 31, constructed here in the form of a yoke, which units can be fastened on the pressure accumulator 5 and/or on a buckle part base body 29—here of the buckle part 2—by means of the fastening arrangement 31. These pre-fabricated units can be marketed commercially in this form and combined with the respectively required buckles 1, by the fastening arrangement 31 being fastened in a corresponding buckle part base body 29 of a corresponding buckle 1.

While buckles have been disclosed herein as the attachment mechanism, the present technology generally can be operable with an attachment mechanism having two or more pieces that can hold firm but purposefully can be detached in order to separate. These pieces can detach directly on their body or through a mechanism or series of mechanism that separate the pieces. The separation of the pieces can be caused by a transfer of energy from a release. A release can be on the attachment mechanism itself or through a remote system to transmit, or store and transmit, energy at a time of the user's choosing. Energy transfer disclosed herein includes pneumatics and hydraulics.

Energy can be generated, and stored, then transferred to the attachment mechanism by engaging a trigger mechanism. The trigger mechanism can be located on the attachment mechanism, or attached through transfer elements, such as tubes disclosed herein, to transfer energy from a trigger mechanism separate from the body of the attachment mechanism.

The attachment mechanism can take a variety of forms, but in this embodiment (FIG. 12), the whole is composed of a buckle having a male component and a female component. The male component slides into the female in such a way as to guide the two portions together and lock them in place until purposely released. The buckle can be purposefully released directly on the buckle and through a mechanism to receive energy transferred from a trigger located off of the body of the buckle(s). The buckles can join two masses together in a secure manner by use of a slot at each end sized to receive a part of the mass (e.g., a strap) through these slots. When the trigger is engaged, the attachment mechanism can release its two or more pieces allowing the two masses to be moved away from each other. The slot(s) can be sized to allow various materials (mass) to engage the buckle. In such implementations, high tensile strength textiles, such as fabric and webbing, can be threaded through the slots over a tensioning bar to allow adjustments. When the stored energy from the pressure chamber is transferred to the buckle, the action can release the mechanism that locks the two buckle halves together, and also forcefully ejects the two buckle halves apart.

Energy can be captured and stored by various methods in implementations of the technology, and in disclosed implementations, it can be generated by a pneumatic pump, and stored the energy in a pressure chamber where a trigger can release a portion of the energy to be transferred through a routing mechanism (pneumatic tubing) to the buckle, allowing the two halves to disengage. In some embodiments, a plurality of disengagements can be executed from the amount of energy stored in the pressure chamber.

One or more attachment mechanisms can be linked to a central device to channel the energy. The number can be variable by means of an adaptor to plug in and out the (pneumatic tubing) to the pressure chamber. Each tubing can be run to a separate attachment mechanism. This can allow multiple attachment mechanisms to be released concurrently when the remote trigger is activated. The length of the tubing is adaptable with changing the effect of release. The outer diameter and/or lumen size can be compatible with the receiving adaptor which allows the tubing to plug in/out and lock it in place.

The pressure chamber can contain a high pressure environment, or a vacuum as an energy medium.

A trigger to release pressure can be separate from the body of the attachment mechanism. The trigger can be physically attached to the pressure chamber. In such implementations, there can be a mechanical connection by means of a energy-transferring semi rigid cable used to action the release of pneumatic pressure. The trigger can be placed or affixed to a location by means of a variety of mechanism such as buckle teeth, hook/loop, adhesive, magnetics, suction, and others. In some implementations, buckle teeth serve as a mechanism to securely fasten the trigger mechanism so when the trigger lanyard is engaged, the energy moves from a user's hand, through the trigger, through the cable, to the pressure release mechanism. This can open the valve that allows the stored energy (air pressure) to flow through the pressure tubing to the buckle, where the release mechanism is engaged, and the two halves of the buckle can fall away from each other.

Arresting devices that can be used in the technology are not limited to the arresting device 21 shown in FIG. 1, but also can include a partially threaded screw on the pump axle, a quarter turn lock on the pump axle, and external case or soft sewn pouch. Pneumatic tubing used in the technology can be branched from a single output of the pressure accumulator to a plurality of remotely triggerable releases for the attachment mechanisms.

The invention claimed is:

1. An arrangement comprising:

at least one buckle, wherein each buckle comprises:

at least two buckle parts that are detachably connectable with each other, and at least one release mechanism able to be actuated by means of pressure, for detaching the at least two buckle parts from each other; and at least one pressure accumulator, that is connected via at least one pressure line with the at least one buckle for actuating the at least one release mechanism of the at least one buckle; and at least one release valve for opening a pressure connection, guided via the at least one pressure line, between the at least one pressure accumulator and the at least one buckle; and at least one trigger for actuating the at least one release valve, and at least one pump for building up of pressure in the at least one pressure accumulator.

2. The arrangement according to claim 1, wherein the at least one pump further comprises a grip element, and the grip element is operative to actuate the at least one pump.

3. The arrangement according to claim 1, wherein the at least one pressure accumulator and the at least one pump are arranged in a shared housing or have separate housings and are connected with each other via a pressure line.

4. The arrangement according to claim 1, wherein the at least one pressure accumulator and each buckle are separate components of the arrangement, which are connected with each other by means of a pressure line.

5. The arrangement according to any one of claims 1 to 4, wherein the at least one trigger has a release element that is able to be actuated manually.

6. The arrangement according to claim 5, wherein at least the at least one pressure accumulator and the at least one pump are arranged in a shared housing and the manually actuatable release element is arranged directly on the shared housing.

7. The arrangement according to claim 5, wherein the manually actuatable release element for actuating the at least one release valve is connected with the at least one release valve via an electric cable or via a Bowden cable.

8. The arrangement according to claim 5, wherein the manually actuatable release element for actuating the at least one release valve with manual activation, is able to be actuated starting from a position of rest by pulling in drawing directions which differ from each other, wherein at least one plane drawing directions are possible in an angle range of at least 90°, preferably of at least 180°.

9. The arrangement according to claim 1, wherein the at least one pump has at least one pump plunger and at least one pump cylinder, wherein the at least one pump plunger is mounted for pumping in the at least one pump cylinder so as to be displaceable to and fro between a maximum extended position and a maximum retracted position.

10. The arrangement according to claim 9, wherein on the at least one pump plunger or on the at least one pump cylinder a grip element of the at least one pump is arranged, which is also able to be gripped by hand in the maximum retracted position, and on an end region of the at least one pump plunger on the grip element side a seal is arranged, which seals off the at least one pump cylinder with respect to an exterior in the maximum retracted position.

11. The arrangement according to claim 9, wherein it has an arresting device for the at least one pump plunger, by which the at least one pump plunger is able to be arrested in the maximum retracted position.

12. The arrangement according to claim 11, wherein the arresting device is a tension band.

13. The arrangement according to claim 1, wherein in or on the at least one pressure accumulator a pressure indicator and/or a pressure relief valve and/or in or on the at least one pressure accumulator or in the at least one pressure line a ventilation valve is arranged.

14. The arrangement according to claim 1, wherein each release mechanism of a buckle has a release plunger, displaceably mounted between a maximum retracted position and a maximum extended position in a release cylinder, wherein the release plunger has an actuating end, by which it can actuate a lock of the at least two buckle parts for detaching the at least two buckle parts from each other, wherein the release plunger in a region of the actuating end has a seal which seals off the release cylinder with respect to an exterior in the maximum retracted position of the release plunger.

15. The arrangement according to claim 14, wherein each release mechanism of a buckle has a release plunger displaceably mounted between a maximum retracted position and a maximum extended position in a release cylinder, and the release plunger and the release cylinder and a pressure line are part of a prefabricated unit which is able to be fastened on the at least one pressure accumulator and/or on a buckle part base body of one of the at least two buckle parts by means of at least one fastening arrangement.

* * * * *